US005470686A

United States Patent [19]

Suematsu et al.

[11] Patent Number: 5,470,686

[45] Date of Patent: Nov. 28, 1995

[54] IMAGE FORMING APPARATUS

[75] Inventors: Hiroyuki Suematsu; Hisayuki Ochi; Manabu Ohno; Tetsuhito Kuwashima, all of Yokohama, Japan

[73] Assignee: Canon Kabushiki Kaisha, Tokyo, Japan

[21] Appl. No.: 253,209

[22] Filed: Jun. 2, 1994

Related U.S. Application Data

[63] Continuation of Ser. No. 7,826, Jan. 22, 1993, abandoned, which is a continuation of Ser. No. 558,438, Jul. 27, 1990, abandoned.

[30] Foreign Application Priority Data

Jul. 28, 1989 [JP] Japan ..... 1-194024

[51] Int. Cl.[6] ..... G03G 9/00

[52] U.S. Cl. ..... 430/111; 430/106.6; 430/110; 358/401; 355/259

[58] Field of Search ..... 430/111, 106.6, 430/110; 358/401; 355/259

[56] References Cited

U.S. PATENT DOCUMENTS

| | | | |
|---|---|---|---|
| 3,863,603 | 2/1975 | Buckley et al. | 118/637 |
| 4,057,666 | 11/1977 | Drummond, Jr. | 428/35 |
| 4,385,829 | 3/1983 | Nakahata et al. | 430/122 |
| 4,522,907 | 6/1985 | Mitsuhashi et al. | 430/102 |
| 4,674,441 | 6/1987 | Kohyama | 118/707 |
| 4,849,316 | 7/1989 | Kawaski et al. | 430/106.6 |
| 4,939,060 | 7/1990 | Tomiyama et al. | 430/106.6 |
| 4,943,504 | 7/1990 | Tomura et al. | 430/111 |
| 4,952,476 | 10/1990 | Sakashita et al. | 430/106.6 |
| 4,966,829 | 10/1990 | Yasuda et al. | 430/109 |
| 5,041,351 | 8/1991 | Kitamori et al. | 430/106.6 |
| 5,114,823 | 5/1992 | Tomura et al. | 430/111 |

FOREIGN PATENT DOCUMENTS

| | | |
|---|---|---|
| 0259819 | 3/1988 | European Pat. Off. . |
| 57-66443 | 4/1982 | Japan . |
| 58-178380 | 10/1983 | Japan . |

*Primary Examiner*—Mark A. Chapman

*Attorney, Agent, or Firm*—Fitzpatrick, Cella, Harper & Scinto

[57] ABSTRACT

An image forming apparatus is constituted by an image-bearing member for bearing a latent image, and a developing apparatus for developing the latent image. The developing apparatus is constituted by a developer container for containing a developer, a developer-carrying member for carrying and conveying the developer contained in the developer container to a developing zone opposite the image-bearing member, and an elastic blade for regulating the developer carried and conveyed on the developer-carrying member to a prescribed thickness to form a thin developer layer on the developer-carrying member. A developer suitable for use in the above developing apparatus is given by a toner, which comprises a binder resin composition which contains 10–70 wt. % of a THF (tetrahydrofuran)-insoluble content and the remainder of a THF-soluble content including a component with a molecular weight of 10000 or below on a GPC (gel permeation chromatography) chromatogram of the THF-soluble content constituting 10–50 wt. % of the binder resin.

97 Claims, 5 Drawing Sheets

IMAGE FORMING APPARATUS

This application is a continuation of application Ser. No. 08/007,826 filed Jan. 22, 1993, now abandoned; which in turn, is a continuation of application Ser. No. 07/558,438, filed Jul. 27, 1990, now abandoned.

FIELD OF THE INVENTION AND RELATED ART

The present invention relates to an image forming apparatus including an image bearing member for forming thereon a latent image and a developing apparatus for developing the latent image with a developer to form a visual image, particularly an image forming apparatus having a developing apparatus wherein a thin layer of a developer is formed by an elastic blade on a developer-carrying member for carrying the developer contained in a developer container to a developing zone opposite an image-bearing member.

Hitherto, various developing apparatus have been proposed for visualizing a latent image formed on an image-bearing member by electrophotography or electrostatic recording. An example thereof is illustrated in FIG. 6.

Referring to FIG. 6, a developing apparatus 1 includes a developer container 2 for holding a developer, and a developer-carrying member 6 for carrying and conveying the developer in the developer container 2 to a developing zone 4 opposite an image-bearing member 3. The developer-carrying member 6 may assume various structures including an ordinary one comprising a developing sleeve 8 enclosing a magnet 7.

The developing apparatus is equipped with a developer regulating member 9 for regulating the developer carried on the developer-carrying member 6 and conveyed to the developing zone 4 to a prescribed thickness to form a thin developer layer on the developer-carrying member 6. It is an essentially important technique to form such a layer of developer on the developer-carrying member 6 in order to ensure the uniformity of a solid black image, particular in a developing apparatus using a mono-component type developer. Various proposals have been made as to the materials and structures of the developer regulating member.

Heretofore, such a developer regulating member 6 has been constituted as a rigid blade disposed with a small spacing from the developer-carrying member 6. On the other hand, an elastic blade like one denoted by a reference numeral 9 composed of an elastic material has been proposed in respect of a good stability against variations in environmental conditions in providing the thin developer layer on the developer-carrying member 6 with a triboelectric charge (Japanese Laid-Open Patent Applications (KOKAI) JP-A 54-43038 and JP-A 58-116559).

The elastic blade 9 may be constituted by a known elastic material inclusive of an elastomer, such as urethane rubber, silicone rubber or NBR; an elastic metal, such as phosphor bronze and stainless steel; or an elastic resin, such as polyethylene terephthalate or high-density polyethylene. The elastic blade 9 is abutted or pressed against the developer-carrying member owing to an elasticity inherent to the material and is fixed to the developer container 2 by a blade holding member 10.

In such a developing apparatus using an elastic blade 9, a pressing force acting between the elastic blade and the developer-carrying member 6 is closely related to the resultant image density. In the case of using a mono-component-type developer, a higher pressing force provides a higher image density unless the developer coating rate is 0.8 mg/cm$^2$ or below. For this reason, there has been a tendency that the elastic blade 9 is pressed against the developer-carrying member 6 at a still higher pressure.

As a result, as the repetition of developing operation occurs while rotating the developer-carrying member 6, the toner or additives contained in the developer is liable to stick to or form a filming contamination on the surface of the developer-carrying member 6 and the elastic blade 9. In an extreme case, the rotation torque of the developer-carrying member becomes too large, and there arise several difficulties such that a larger spacing is formed between the image bearing member and the developer-carrying member and the developer-carrying member does not rotate but merely causes a slippage of rotation gear. In some cases, the breakage of the drive gear could occur.

On the other hand, the developer transferred onto a transfer material such as paper may be fixed onto the transfer material by a fixing means, such as a hot-pressure roller fixer, a hot melt fixer or a pressure fixer as by pressure rollers. The heat energy and pressure are preferably smaller in view of the economical factor, structural stability of the apparatus and easiness of designing. Accordingly, there has been a tendency to use a soft developer component having a low melt viscosity, a low melting point and a low yield pressure. On the other hand, it is also important to include a rigid component in the developer in respects of durability, fixability and anti-offset characteristic.

In order to satisfy such mutually contrary factors, it is generally advantageous that the developer is composed from a binder resin having a molecular weight distribution providing both a soft and a rigid component.

However, such a tendency with a developer is liable to promote the above-mentioned problems accompanying the use of an elastic blade pressed against a developer-carrying member and a provide difficulties in designing in consideration of compatibility between the elastic blade and the developer.

SUMMARY OF THE INVENTION

A generic object of the present invention is to provide an image forming apparatus having solved the above-mentioned problems.

A more specific object of the present invention is to provide an image forming apparatus equipped with a developing apparatus having an elastic blade for applying a developer containing a toner onto a developer-carrying member.

Another object of the present invention is to provide an image forming apparatus free from toner sticking or filming contamination on the surfaces of the elastic blade and the developer-carrying member even when a strong pressing force is exerted between them.

Another object of the present invention is to provide an image forming apparatus wherein the drive torque of the developer-carrying member is decreased to prevent inversion or peeling of the elastic blade.

A further object of the present invention is to provide an image forming apparatus whereby the breakage of the developer-carrying member drive gear can be prevented to allow good image formation.

According to the present invention, there is provided an image forming apparatus, comprising: an image-bearing member for bearing a latent image, and a developing apparatus for developing the latent image, the developing apparatus comprising:

a developer container for containing a developer, wherein the developer comprises a toner, and the toner comprises a binder resin composition which contains 10–70 wt. % of a THF (tetrahydrofuran)-insoluble content and the remainder of a THF-soluble content including a component with a molecular weight of 10000 or below on a GPC (gel permeation chromatography) chromatogram of the THF-soluble content constituting 10–50 wt. % of the binder resin;

a developer-carrying member for carrying and conveying the developer contained in the developer container to a developing zone opposite the image-bearing member; and an elastic blade for regulating the developer carried and conveyed on the developer-carrying member to a prescribed thickness to form a thin developer layer on the developer-carrying member.

According to another aspect of the present invention, there is provided a facsimile apparatus, comprising: an electrophotographic apparatus and a receiving means for receiving image data from a remote terminal, wherein said electrophotographic apparatus comprises: an image-bearing member for bearing a latent image, and a developing apparatus for developing the latent image, the developing apparatus comprising:

a developer container for containing a developer, wherein the developer comprises a toner, and the toner comprises a binder resin composition which contains 10–70 wt. % of a THF (tetrahydrofuran)-insoluble content and the remainder of a THF-soluble content including a component with a molecular weight of 10000 or below on a GPC (gel permeation chromatography) chromatogram of the THF-soluble content constituting 10–50 wt. % of the binder resin;

a developer-carrying member for carrying and conveying the developer contained in the developer container to a developing zone opposite the image-bearing member; and an elastic blade for regulating the developer carried and conveyed on the developer-carrying member to a prescribed thickness to form a thin developer layer on the developer-carrying member.

These and other objects, features and advantages of the present invention will become more apparent upon a consideration of the following description of the preferred embodiments of the present invention taken in conjunction with the accompanying drawings.

DETAILED DESCRIPTION OF THE INVENTION

We have studied what properties are required of a developer magnetic toner applied to melt-fusion fixation as by a hot roller fixer or a radiation heating fixer to avoid sticking onto the surfaces of an elastic blade and a developer-carrying member used in developer application by such an elastic blade on the developer-carrying member while maintaining its fixability, durability and anti-offset characteristic. As a result, we have found it possible to provide such a toner by using a specific binder to appropriately control the rigidity and strength of the toner.

Hereinbelow, the image forming apparatus of the present invention will be explained with reference to drawings.

Figure 1:
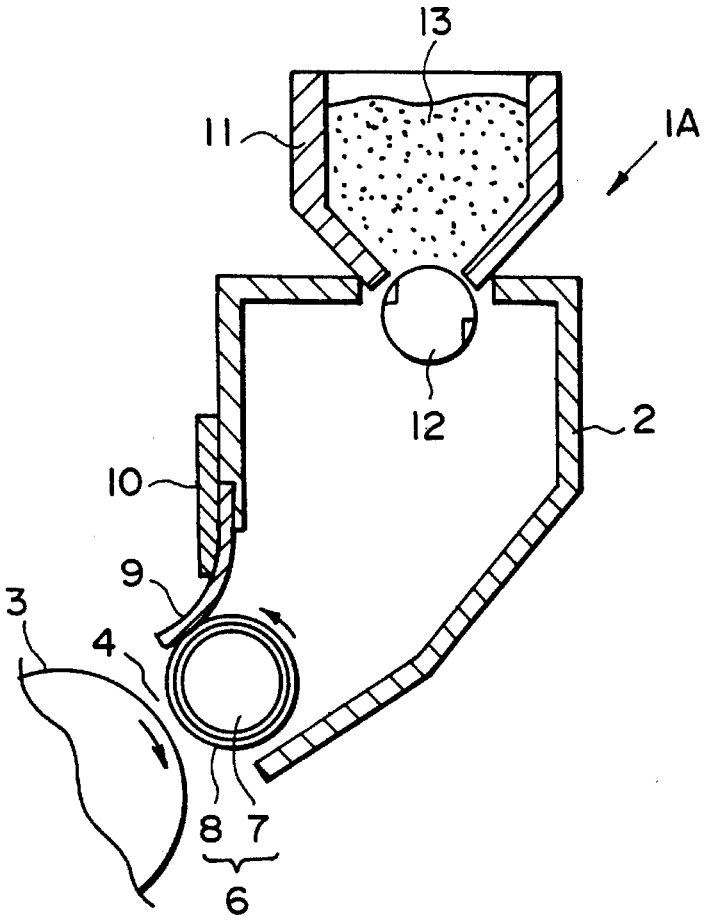
FIG. 1 is a schematic sectional view of an embodiment according to the present invention.
Figure 2:
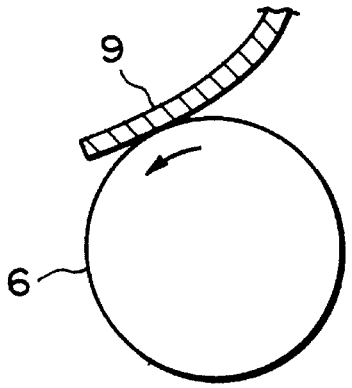
FIG. 2 is a sectional view showing a relationship between an elastic blade and a developer-carrying member in a developing apparatus.

FIGS. 1 and 2 show an embodiment of the image forming apparatus according to the present invention. In this embodiment, an image-bearing member 3 comprising a photosensitive material or a dielectric material in the form of a drum is used, and thereon, a latent image is formed by an image forming process well known to one of an ordinary skill in the art. The latent image is visualized by a developing apparatus, and the resultant visual image is transferred to a transfer material and fixed by a fixing apparatus to provide a permanent image. Such latent image-forming means, transfer means,fixing means, etc. are disposed around the image-bearing member 3 but omitted from being shown, and only the developing apparatus is shown.

A developing apparatus 1A according to the present invention comprises a developer container 2 for storing a developer, a developer-carrying member 6 for carrying and conveying the developer in the developer container 2 from the developer container 2 to a developing zone 4 opposite the image-bearing member 3, and an elastic blade 9 for regulating the developer carried on the developer-carrying member and conveyed to the developing zone to a prescribed thickness to form a thin layer of the developer on the developer-carrying member 6.

The developer-carrying member 6 may assume an arbitrary structure but is composed as a developing sleeve 8 containing therein a magnet 7 in this embodiment. The developing sleeve 8 may be a cylindrical revolution body as shown but can be a circulating endless belt. The sleeve may preferably comprises aluminum or stainless steel (SUS).

The elastic blade 9 may be constituted as an elastic plate composed of an elastic material inclusive of an elastomer, such as urethane rubber, silicone rubber, or NBR; an elastic metal, such as phosphor bronze and stainless steel; and an elastic resin, such as polyethylene terephthalate, or high-density polyethylene. The elastic blade 9 is abutted or pressed against the developer-carrying member 6 due to an elasticity inherent to the material and fixed to the developer container 2 by a blade-holding member 10 composed of a rigid material, such as iron. In this embodiment, the elastic blade 9 may preferably be abutted at a linear pressure of 5–80 g/cm against the developer-carrying member 6 in a forward direction as shown or in a counter direction with respect to the rotation direction of the developer-carrying member 6.

Figure 3:
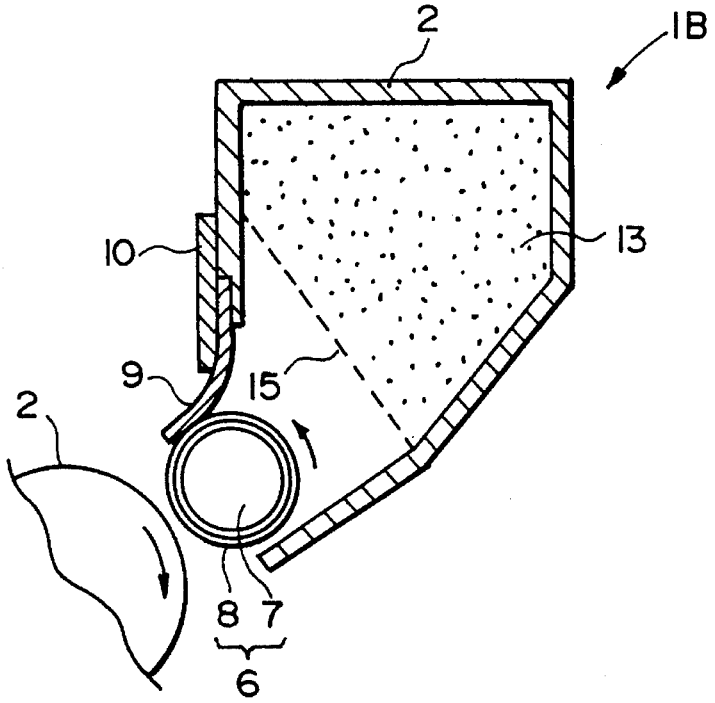
FIGS. 3–5 and 7 are schematic sectional views each showing another embodiment of the image forming apparatus according to the present invention.

FIG. 3 shows another embodiment of the image forming apparatus according to the present invention. FIG. 3 also omits showing of various means related to image formation disposed around the image bearing member 3.

The image forming apparatus shown in FIG. 3 includes a developing apparatus 1B having a structure basically the same as that of the developing apparatus 1A explained with reference to FIG. 1. In this embodiment, however, the developing apparatus 1B is constituted as a single unit adapted for replacement and disposition. In this developing apparatus, the developer before use is separated by a sealing member 15 of, e.g., a vinyl sheet fixed by an adhesive to the developer container 2 disposed in a different side from the developer-carrying member 6 so that the image forming apparatus or developing apparatus can be conveniently transported and stored while preventing the developer from being leaked out of the developing apparatus. At the time of use, the developing apparatus unit is attached to the image forming apparatus and the sealing member 15 is pulled out to be removed in a direction perpendicular to the drawing of FIG. 3, so that the developer 13 is supplied onto the developer-carrying member 6 to allow image formation.

Figure 4:
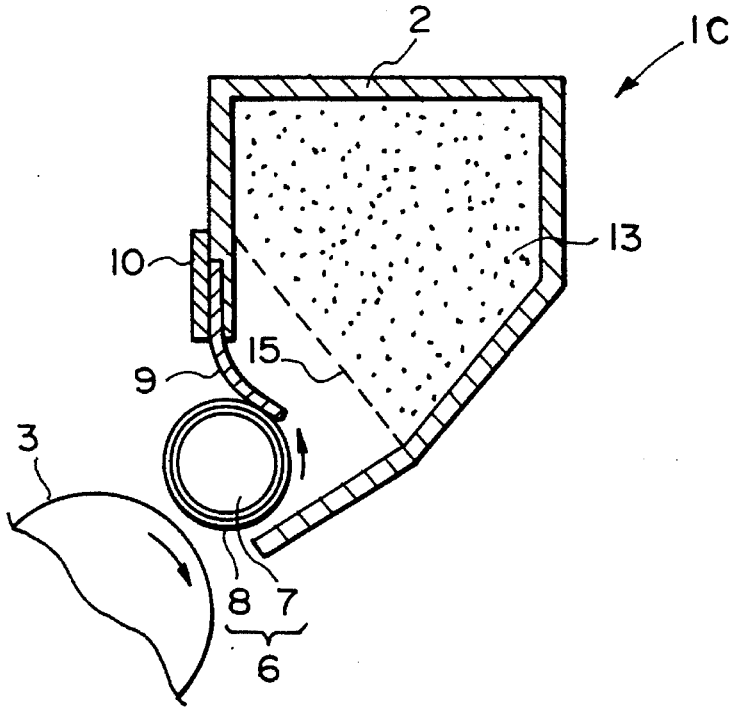

It is also possible use a developing apparatus 1C as shown in FIG. 4, wherein the elastic blade 9 is abutted against the developer-carrying member 6 in a counter direction with respect to the rotation direction of the developer-carrying member 6.

Figure 5:
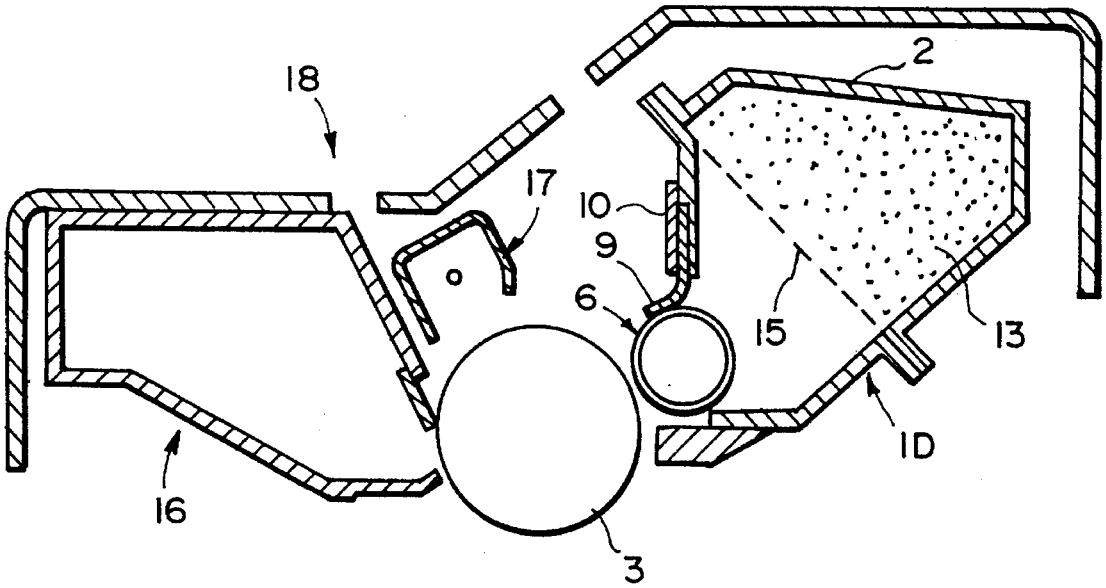
Figure 6:
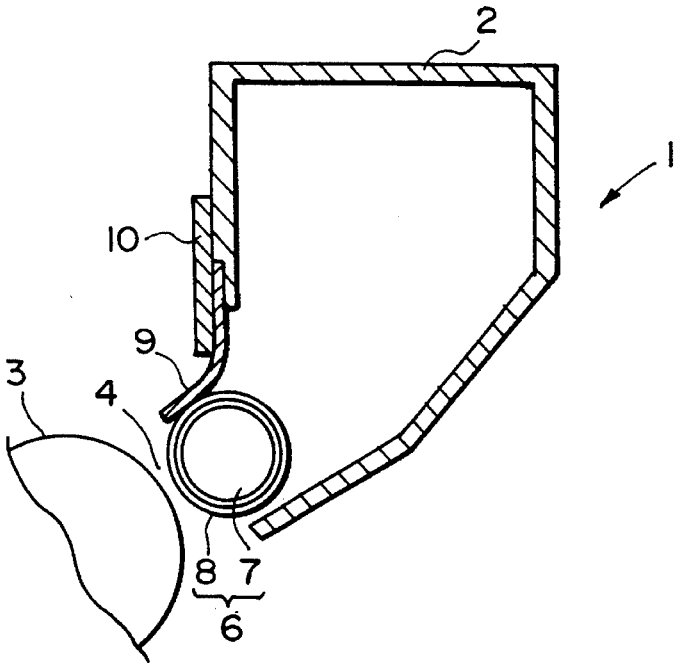
FIG. 6 is a schematic sectional view of a conventional image forming apparatus.

FIG. 5 shows another embodiment of the image forming apparatus according to the present invention. This embodiment of the image forming apparatus according to electrophotography comprises an image forming unit 18 (so-called "cartridge") which integrally includes a developing apparatus 1D, an image-bearing member in the form of a drum (photosensitive drum) 3, a cleaner 16, and a primary charger 18.

In this embodiment, the image forming unit 18 is replaced by a new one when the developer 13 in the developing apparatus 1D has been consumed.

In this embodiment, a mono-component type developer is used as the developer 13 in the developing apparatus 1D. In this embodiment, it is essentially important to maintain a prescribed spacing between the photosensitive drum 3 and the developer-carrying member 6 so that a prescribed electric field is formed between the photosensitive drum and the developer-carrying member 6 to allow a suitable developing operation. In this embodiment, the spacing is measured and set to 300 microns as the central value with a tolerance of ±30 microns.

Figure 7:
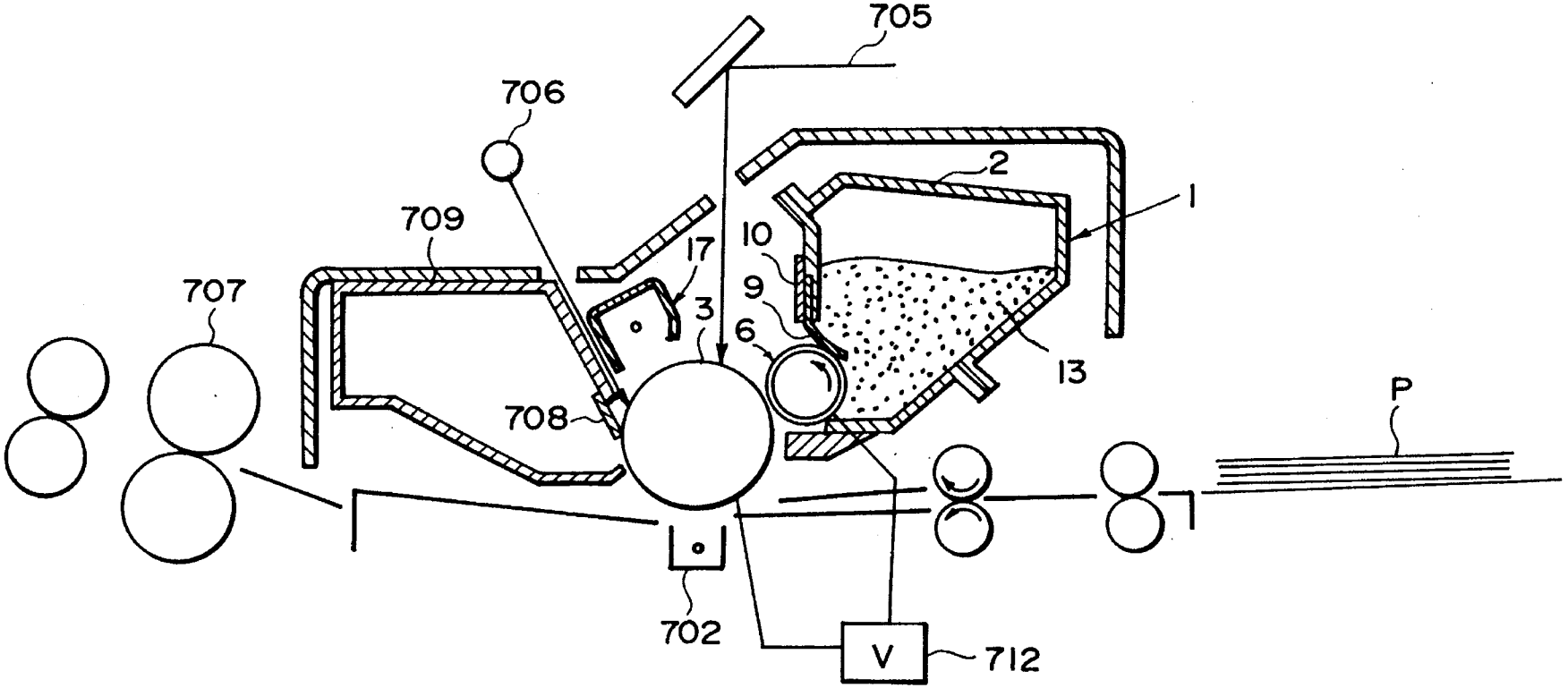

Referring to FIG. 7, another embodiment of the image forming apparatus according to the present invention is explained.

An OPC photosensitive member 3 surface is negatively charged by a primary charger 17, subjected to image-scanning with laser light 705 to form a digital latent image, and the resultant latent image is reversely developed with a negatively chargeable monocomponent magnetic developer 13 by means of a developing apparatus 1 wherein the developer 13 contained in a developer container 2 is applied onto a developing sleeve 6 containing a magnet therein for development by means of an elastic blade 9 composed of urethane rubber which is disposed in a counter direction as shown with respect to the rotation direction of the sleeve 6. In the developing zone, an alternating bias, pulsed bias and/or DC bias is applied between the conductive substrate of the photosensitive drum 3 and the developing sleeve 6 by a bias voltage application means 712. When a transfer paper P is conveyed to a transfer zone, the paper is charged from the back side (opposite side with respect to the photosensitive drum) by a transfer means 702, whereby the developed image (toner image) on the photosensitive drum is electrostatically transferred to the transfer paper P. Then, the transfer paper P is separated from the photosensitive drum 3 and subjected to fixation by means of a hot pressing roller fixer 707 for fixing the toner image on the transfer paper P.

Residual monocomponent developer remaining on the photosensitive drum after the transfer step is removed by a cleaner 709 having a cleaning blade 708. The photosensitive drum 501 after the cleaning is subjected to erase-exposure for discharge by an exposure means 706 and then subjected to a repeating cycle commencing from the charging step by the charger 17.

The electrostatic image-bearing member (photosensitive drum) comprises a photosensitive layer and a conductive substrate and rotates in the direction of the arrow. The developing sleeve. 6 comprising a non-magnetic cylinder as a toner-carrying member rotates so as to move in the same direction as the electrostatic image holding member 3 surface at the developing zone. Inside the non-magnetic cylinder sleeve 6, a multi-pole permanent magnet (magnet roll) as a magnetic field generating means is disposed so as not to rotate. The monocomponent insulating magnetic developer 13 in the developing vessel 2 is applied onto the non-magnetic cylinder sleeve 6 and the toner particles are provided with, e.g., a negative triboelectric charge due to friction between the sleeve 6 surface and the toner particles. Further, the elastic blade 9 is pressed against the cylinder surface, whereby the thickness of the developer layer is regulated at a thin and uniform thickness (30–300 microns) which is thinner than the spacing between the electrostatic image bearing member 3 and the toner carrying member 6 so that the developer layer does not contact the image bearing member 3. The revolution speed of the toner carrying member 6 is so adjusted that the circumferential velocity of the sleeve 6 is substantially equal to or close to that of the electrostatic image bearing member 3. In the developing zone, an AC bias or a pulsed bias may be applied between the toner carrying member 6 and the electrostatic image bearing surface by the biasing means 712. The AC bias may comprise f=200–4000 Hz and Vpp=500–3000 V.

In the developing zone, the toner particles are transferred to the electrostatic image under the action of an electrostatic force exerted by the electrostatic image bearing surface and the AC bias or pulsed bias.

Figure 8:
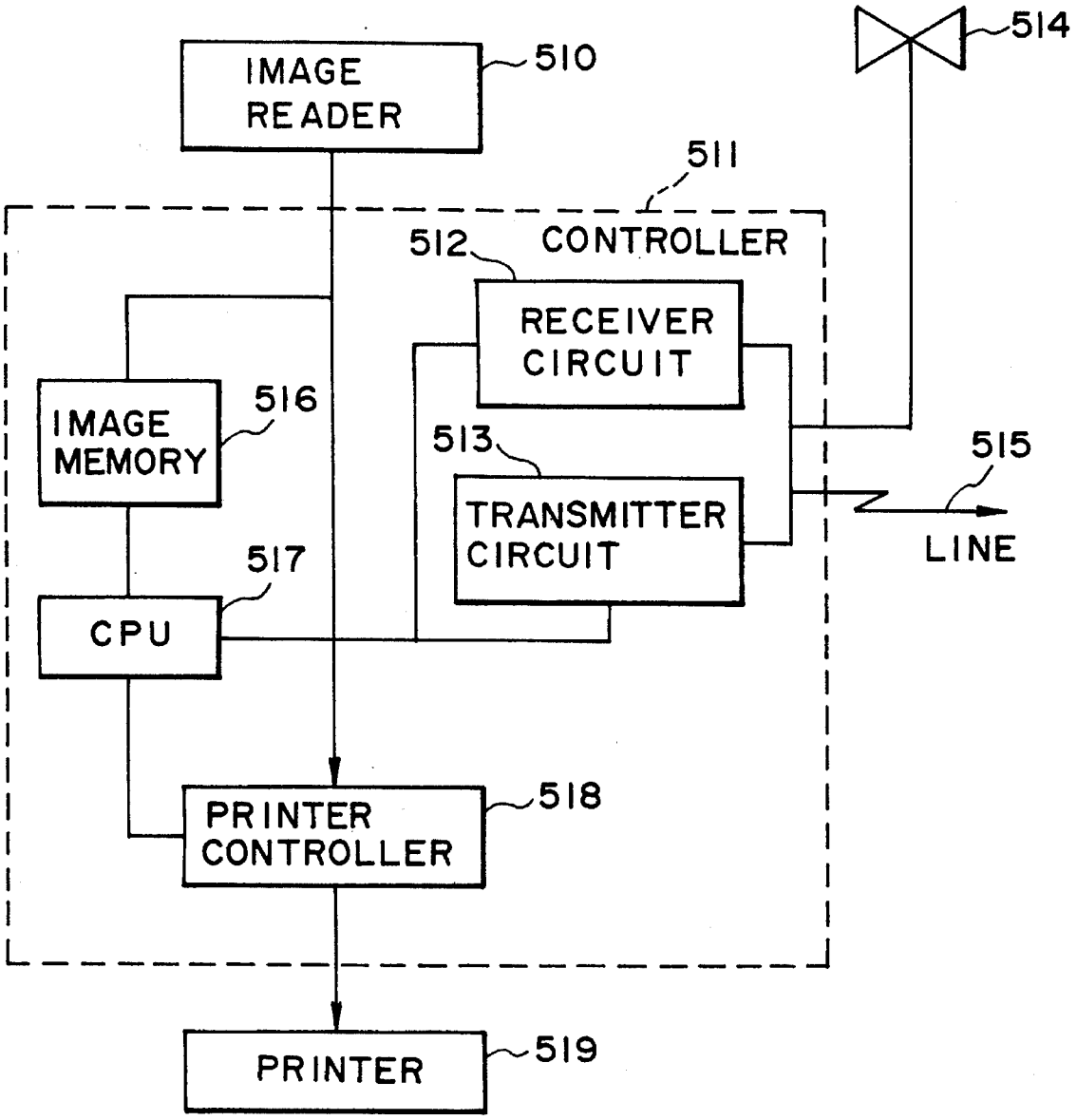
FIG. 8 is a block diagram of a system constituting a facsimile apparatus.

In a case where the image forming apparatus according to the present invention is used as a printer for facsimile, the laser light 705 may be replaced by exposure light image for printing received data. FIG. 8 is a block diagram for illustrating such an embodiment.

Referring to FIG. 8, a controller 511 controls an image reader (or image reading unit) 510 and a printer 519. The entirety of the controller 511 is regulated by a CPU 517. Data read from the image reader 510 is transmitted through a transmitter circuit 513 to a remote terminal such as another facsimile machine. On the other hand, data received from a remote terminal is transmitted through a receiver circuit 512 to a printer 519. An image memory 516 stores prescribed image data. A printer controller 518 controls the printer 519. A telephone handset 514 is connected to the receiver circuit 512 and the transmitter circuit 513.

More specifically, an image received from a line (or circuit) 515 (i.e., image data received a remote terminal connected by the line) is demodulated by means of the receiver circuit 512, decoded by the CPU 517, and sequentially stored in the image memory 516. When image data corresponding to at least one page is stored in the image memory 516, image recording or output is effected with respect to the corresponding page. The CPU 517 reads image data corresponding to one page from the image memory 516, and transmits the decoded data corresponding to one page to the printer controller 518. When the printer controller 518 receives the image data corresponding to one page from the CPU 517, the printer controller 518 controls the printer 519 so that image data recording corresponding to the page is effected. During the recording by the printer 519, the CPU 517 receives another image data corresponding to the next page.

Thus, receiving and recording of an image may be effected in the above-described manner.

In the electrophotographic apparatus, plural members inclusive of some of the above-mentioned members such as electrostatic image-bearing member or the photosensitive member, developing apparatus and cleaning means can be integrally combined to form an apparatus unit so that the unit can be connected to or released from the apparatus body. For example, at least one of the charging means, developing apparatus and cleaning means can be integrally combined with the photosensitive member to form a single unit so that it can be attached to or released from the apparatus body by means of a guide means such as a guide rail provided to the body.

Next, the toner used in the present invention will be explained. The binder resin of the toner used in the invention is required to have an accurately controlled molecular weight distribution. More specifically, the THF-insoluble content of the binder resin is controlled within the range of 10–70 wt. %. Further, the THF-soluble content includes a component of molecular weight being 10,000 or below on the GPC chromatogram in a proportion of 10–50 wt. %, preferably 20–39 wt. %, of the binder resin. In order to provide satisfactory performances, it is further preferred that the GPC chromatogram provides a peak in the molecular weight range of 2000 or above to below 15000, more preferably 2000 to 10000, further preferably 2000 to 8000, and a peak or shoulder in the molecular weight range of 15,000 to 100,000, more preferably 20,000 to 70,000.

If the component of molecular weight being 10,000 or below exceeds 50 wt. %, the toner sticking onto apparatus members is liable to occur during the step of toner application onto a developer-carrying member by an elastic blade, and this tendency is promoted if the THF-insoluble content is below 10 wt. %.

In the case where the THF-insoluble content exceeds 70 wt. %, the developer per se is caused to have too large a rigidity so that the elastic blade is liable to be damaged to promote the toner sticking onto the apparatus members. This tendency is more pronounced when the molecular weight portion of 10,000 or below is less than 10 wt. %.

From the above, it is preferred for the binder resin, particularly one for a toner for hot melt fixation, to satisfy the above-mentioned molecular weight distribution so as to obviate difficulties accompanying the use of an elastic blade.

Herein, the THF-soluble content refers to a polymer component (substantially a crosslinked polymer component) which is insoluble in solvent THF (tetrahydrofuran) in the resin composition (binder resin) constituting a toner, and it may be used as a parameter for indicating the degree of crosslinking of the resin composition containing a crosslinked component. It is to be noted however that a polymer having a low degree of crosslinking can be soluble in THF. For example, a crosslinked polymer obtained through solution polymerization can be THF-soluble even if it has been obtained in the presence of a relatively large amount of crosslinking agent such as divinylbenzene.

The THF-insoluble content may be defined as a value obtained in the following manner.

0.5–1.0 g of a toner sample is weighed ($W_1$g) and placed in a cylindrical filter paper (e.g., No. 86R available from Toyo Roshi K.K.) and then subjected to extraction with 100 to 200 ml of solvent extraction by using a Soxhlet's extractor for 6 hours. The soluble content extracted with the solvent THF is recovered by evaporation and dried for several hours at 100° C. under vacuum to measure a weight ($W_2$g) of the THF-soluble content. On the other hand, the weight ($W_3$g) of the components, such as the magnetic material and/or pigment, other than the resin component in the toner is separately measured. Then, the THF-insoluble content is given by the following equation: THF-insoluble content (%)=$[W_1-(W_2+W_3)]/[W_1-W_3]\times 100$ The GPC (gel permeation chromatography) measurement and identification of molecular weight corresponding to the peaks and/or shoulders may be performed under the following conditions.

A column is stabilized in a heat chamber at 40° C., tetrahydrofuran (THF) solvent is caused to flow through the column at that temperature at a rate of 1 ml/min., and 50–200 μl of a sample resin solution in THF at a concentration of 0.05–0.6 wt. % is injected. The identification of sample molecular weight and its molecular weight distribution is performed based on a calibration curve obtained by using several monodisperse polystyrene samples and having a logarithmic scale of molecular weight versus count number. The standard polystyrene samples for preparation of a calibration curve may be those having molecular weights of, e.g., $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$ available from, e.g., Pressure Chemical Co. or Toyo Soda Kogyo K.K. It is appropriate to use at least 10 standard polystyrene samples. The detector may be an RI (refractive index) detector.

For accurate measurement of molecular weights in the range of $10^3$–$4\times10^6$, it is appropriate to constitute the column as a combination of several commercially available polystyrene gel columns. A preferred example thereof may be a combination of μ-styragel 500, $10^3$, $10^4$ and $10^5$ available from Waters Co.; a combination of Shodex KF-80M, 802, 803, 804 and 805; or a combination of TSK gel G1000H, G2000H, G2500H, G3000H, G4000H, G5000H, G6000H, G7000H and GMH available from Toyo Soda K.K.

The content of a component having a molecular weight of 10,000 or below in the binder resin is measured by cutting out a chromatogram of the corresponding molecular weight portion and calculating a ratio of the weight thereof with that of the chromatogram covering the molecular weight range of 10,000 or higher, to derive the weight % thereof in the whole binder resin including the above-mentioned THF-insoluble content.

The present invention is particularly effective when applied to a magnetic toner containing a magnetic material. It is preferable to select a magnetic material having a good dispersibility in a binder resin containing a THF-insoluble content. The magnetic material may have a bulk density of 0.35 g/ml or higher, preferably 0.6 g/ml or higher, more preferably 0.8 g/ml or higher, still more preferably in the range of 0.9–1.5 g/ml. If the bulk density is below 0.35 g/ml, the dispersion of the magnetic material in the toner can be insufficient to cause localization of the magnetic material so that the effect of the binder resin having a strictly restricted molecular weight distribution may not be fully exhibited.

In case where the magnetic material comprises cubic crystals, the particles are liable to damage the elastic blade surface because of their angular shape so that spherical particles providing a rather large bulk density are preferred.

The bulk density of a magnetic material may for example be increased by treating the material by a means, such as a fret mil.

The bulk density (g/cc) used herein refers to a value measured according to JIS (Japanese Industrial Standards) K-5101.

The spherical magnetic material may preferably have a remanence ($\sigma_r$) of 5 emu/g or below and a coercive force (Hc) of 100 oersted (Oe) or below.

The magnetic material may preferably be contained in a proportion of 10–70 wt. % of the toner.

The toner resin composition used in the present invention may suitably comprise a product of polymerization of one or monomers selected from styrene monomers, acrylic acid monomers, methacrylic acid monomers and derivatives of these in view of developing performances and charging characteristic. Examples of the styrene monomers may include: styrene, α-methylstyrene, vinyltoluene, and chlorostyrene. Examples of the acrylic acids, methacrylic acids and their derivatives may include: acrylic acid and acrylic acid esters, such as methyl acrylate, ethyl acrylate, propyl acrylate, butyl acrylate, octyl acrylate, 2-ethylhexyl acrylate, n-tetradecyl acrylate, n-hexadecyl acrylate, lauryl acrylate, cyclohexyl acrylate, diethylaminoethyl acrylate, and dimethylaminoethyl acrylate; and methacrylic acid and methacrylic acid esters, such as methyl methacrylate, ethyl methacrylate, propyl methacrylate, butyl methacrylate, amyl methacrylate, hexyl methacrylate, 2-ethylhexyl methacrylate, octyl methacrylate, decyl methacrylate, dodecyl methacrylate, lauryl methacrylate, cyclohexyl methacrylate, phenyl methacrylate, 2-hydroxyethyl methacrylate, 2-hydroxypropyl methacrylate, dimethylaminoethyl methacrylate, glycidyl methacrylate, and stearyl methacrylate. In addition to the above monomers, it is possible to use another monomer, such as acrylonitrile, 2-vinylpyridine, 4-vinylpyridine, vinylcarbazole, vinyl methyl ether, butadiene, isoprene, maleic anhydride, maleic acid, maleic acid monoesters, maleic acid diesters, and vinyl acetate, in a minor amount not giving ill effects to the present invention.

A crosslinking agent may be used to provide a THF-insoluble content in the binder resin composition. Examples of difunctional crosslinking agents may include: divinylbenzene, bis(4-acryloxypolyethoxyphenyl)propane, ethyleneglycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycol #200, #400 and #600, dipropylene glycol diacrylate, polypropylene glycol diacrylate, polyester-type acrylates (e.g., one known by a trade name of "MAZDA", available from Nihon Kayaku K.K.), and methacrylates obtained by substituting methacrylate groups for the acrylate groups in the above acrylates.

Examples of polyfunctional crosslinking agents may include: pentaerythritol triacrylate, trimethylolethane triacrylate, trimethylolpropane triacrylate, tetramethylolmethane tetraacrylate, oligoester acrylate, methacrylates corresponding to the above acrylates, 2,2-bis(4-methacryloxypolyethoxyphenyl)propane, diallyl phthalate, triallyl cyanurate, triallyl trimellitate and diallyl chlorendate.

In the present invention, it is preferred to use, as a binder resin, a resin composition comprising a non-crosslinked or crosslinked first vinyl polymer or copolymer (preferably of a styrene-type) and a crosslinked second vinyl polymer or copolymer (preferably of a styrene-type).

The binder resin according to the present invention may suitably be prepared through a process for synthesizing two or more polymers or copolymers.

For example, a first polymer or copolymer soluble in THF and also in a polymerizable monomer is dissolved in such a polymerizable monomer, and the monomer is polymerized to form a second polymer or copolymer, thus providing a resin composition comprising a uniform mixture of the first polymer or copolymer and the second polymer or copolymer.

The first polymer or copolymer soluble in TFH may preferably be formed through solution polymerization or ionic polymerization. The second polymer or copolymer providing a THF-insoluble content may preferably be prepared through suspension polymerization or bulk polymerization of a monomer dissolving the first polymer or copolymer in the presence of a crosslinking monomer. It is preferred that the first polymer or copolymer is used in a proportion of 10–120 wt. parts, particularly 20–100 wt. parts, per 100 wt. parts of the polymerizable monomer giving the second polymer or copolymer.

Examples of the magnetic material contained in a magnetic toner according to the present invention may include: iron oxide or compound of a divalent metal and iron oxide, such as magnetite, hematite, and ferrites; metals, such as iron, cobalt and nickel, and alloys of these metals with other metals, such as aluminum, cobalt, copper, lead, magnesium, tin, zinc, antimony, beryllium, bismuth, cadmium, calcium, manganese, selenium, titanium, tungsten and vanadium; and mixtures of these materials.

In order to control the chargeability of the toner, it is possible to use a charge control agent as follows.

Nitrofumic acid and its salts as disclosed in JP-A 50-13338, dyes or pigments such as C.I. 14645, complexes of metals such as Zn, Al, Co, Cr and Fe with salicylic acid, naphthoic acid and dicarboxylic acid, sulfonated copper phthalocyanine pigment, styrene oligomer to which nitrile group or halogen group has been introduced, and chlorinated paraffin. In view of dispersibility, it is preferred to select one from metal complex salts of monoazo dyes, metal complexes of salicylic acid, metal complexes of alkylsalicylic acids, metal complexes of naphthoic acid and metal complexes of dicarboxylic acids.

Good results may also be obtained if some additives are added, as desired, to the toner according to the present invention. Examples of such additives may include: lubricants, abrasives, fluidity-imparting agents, anti-caking agents, electroconductivity-imparting agents, fixing aids, and anti-offset agents.

Examples of the lubricants may include: fine powder of materials, such as polytetrafluoroethylene, zinc stearate, and polyvinylidene fluoride, among which polyvinylidene fluoride fine powder is preferred.

Examples of the abrasives may include: fine powders of materials, such as cerium oxide, silicon carbide, and strontium titanate,among which fine powder of strontium titanate is preferred.

Examples of the fluidity-imparting agents may include: fine powders of colloidal silica, hydrophobic colloidal silica, and aluminum oxide, among which hydrophobic colloidal silica fine powder is preferred.

Examples of the electroconductivity-imparting agents may include: fine powders of materials, such as carbon black, zinc oxide, antimony oxide and tin oxide.

Examples of the fixing aids or anti-offset agents may include: low-molecular weight polyethylene, low-molecular weight polypropylene and various waxes.

It is also possible to use small quantities of white fine powder and black fine powder with a triboelectric chargeability of a polarity opposite to that of the toner particles in order to improve the developing characteristic.

The above-mentioned hydrophobic colloidal silica may preferably be hydrophobic colloidal silica treated with a silicone oil or silicone varnish.

The silicone oil or silicone varnish preferably used in the present invention may be those represented by the following formula:

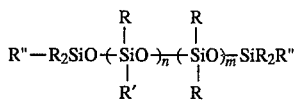

wherein R: a $C_1$–$C_3$ alkyl group, R': a silicone oil-modifying group, such as alkyl, halogen-modified alkyl, phenyl, and modified-phenyl, R": a $C_1$–$C_3$ alkyl or alkoxy group.

Specific examples thereof may include: dimethylsilicone oil, alkyl-modified silicone oil, α-methylstyrene-modified silicone oil, chlorophenylsilicone oil, and fluoro-modified silicone oil. The above silicone oil may preferably have a viscosity at 25° C. of about 50–1000 centi-stokes. A silicon oil having too low a molecular weight can generate a volatile matter under heating, while one having too high a molecular weight has too high a viscosity leading to a difficulty in handling.

In order to treat the silica fine powder with silicone oil, there may be used a method wherein silica fine powder treated with a silane coupling agent is directly mixed with a silicone oil by means of a mixer such as Henschel mixer; a method wherein a silicone oil is sprayed on silica as a base material; or a method wherein a silicone oil is dissolved or dispersed in an appropriate solvent, the resultant liquid is mixed with silica as a base material, and then the solvent is removed to form a hydrophobic silica.

It is further preferred to treat the inorganic fine powder first with a silicone oil or silicone varnish.

When the inorganic fine powder is treated only with a silicone oil, a large amount of silicone oil is required, so that the fine powder can agglomerate to provide a developer with a poor fluidity and the treatment with a silicone oil must be carefully performed. However, if the fine powder is first treated with a silane coupling agent and then with a silicone oil, the fine powder is provided with a good moisture resistance while preventing agglomeration of the powder and thus the treatment effect with a silicone oil can be sufficiently exhibited.

The silane coupling agent used in the present invention may be hexamethyldisilazane or those represented by the formula: $R_mSiY_n$, wherein R: an alkoxy group or chlorine atom, m: an integer of 1–3, Y: alkyl group, vinyl group, glycidoxy group, methacryl group or other hydrocarbon groups, and n: an integer of 3–1. Specific examples thereof may include: dimethyldichlorosilane, trimethylchlorosilane, allyldimethylchlorosilane, allylphenyldichlorosilane, benzyldimethylchlorosilane, vinyltriethoxysilane, γ-methacryloxypropyltrimethoxysilane, vinyltriacetoxysilane, divinylchlorosilane, and dimethylvinylchlorosilane.

The treatment of the fine powder with a silane coupling agent may be performed in a dry process wherein the fine powder is agitated to form a cloud with which a vaporized or sprayed silane coupling agent is reacted, or in a wet process wherein the fine powder is dispersed in a solvent into which a silane coupling agent is added dropwised to be reacted with the fine powder.

The silicone oil or silicone varnish may be used in an amount of 1–35 wt. parts, preferably 2–30 wt. parts, to treat 100 wt. parts of the inorganic fine powder. If the amount of the silicone oil or silicone varnish is too small, it is possible that the moisture resistance is not improved to fail to provide high quality copy images. If the silicon oil or silicone varnish is too much, the inorganic fine powder is liable to agglomerate and even result in free silicone oil or silicone varnish, thus leading to failure in improving the fluidity of the developer.

The hydrophobic colloidal silica may preferably be used in a proportion of 0.1–3.0 wt. parts, particularly 0.6–1.6 wt. parts, per 100 wt. parts of the toner.

The toner used in the present invention may be prepared by a method in which toner constituents are kneaded well in a hot kneading means, such as a kneader or extruder, mechanically crushed and classified; a method wherein a binder resin solution containing other components dispersed therein is spray-dried; a polymerization method wherein prescribed ingredients are dispersed in a monomer constituting a binder resin and the mixture is emulsified, followed by polymerization of the monomer to provide a polymer; etc.

Hereinbelow, some synthesis examples of binder resins used in the present invention will be described.

Synthesis Example 1

200 wt. parts of cumene was charged in a reaction vessel and heated to a reflux temperature. Further, a mixture of 100 wt. parts of styrene monomer and 6.5 wt. parts of benzoyl peroxide was added dropwise thereto in 4 hours under reflux of the cumene. Further, the solution polymerization was completed under reflux of the cumene (146°–156° C.), followed by removal of the cumene. The resultant polystyrene was soluble in THF, showed a main peak at a molecular weight of 4,500 on the GPC chromatogram and showed a Tg (glass transition point) of 58° C.

30 wt. parts of the above polystyrene was dissolved in the following monomer mixture to form a mixture solution.

| (Monomer mixture) | |
|---|---|
| Styrene | 58 wt. parts |
| n-Butyl acrylate | 12 wt. parts |
| Divinylbenzene | 0.26 wt. part |
| di-tert-Butyl peroxide | 1.8 wt. part |

To the above mixture solution was added 170 wt. parts of water containing 0.1 wt. part of incompletely saponified polyvinyl alcohol to form a liquid suspension. The suspension was added to a nitrogen-aerated reaction vessel containing 15. wt. parts of water and subjected to 6 hours of suspension polymerization at 70°–95° C. After the reaction, the product was recovered by filtration, de-watered and dried to obtain a composition comprising polystyrene and styrene-n-butyl acrylate copolymer. The composition was a uniform mixture of a THF-soluble content and a THF-insoluble content and was also a uniform mixture of polystyrene and styrene-n-butyl acrylate copolymer. The resin composition was recovered as a powder fraction of 24 mesh-pass and 60 mesh-on. About 0.5 g of the powder was accurately weighed and placed in a cylindrical filter paper with a diameter of 28 mm and a length of 100 mm (No. 86R, available from Toyo Roshi K.K.), and 200 ml of THF was refluxed at a rate of one time per about 4 min. to measure the THF-insoluble as a portion remaining on the filter paper. The resin composition showed a THF-insoluble content of 28 wt. %. The THF-soluble content was subjected to measurement of molecular weight distribution, whereby the resultant GPC chart showed peaks at molecular weights of about 5,000 and about 50,000 and a content of molecular weight being 10,000 or below of 30 wt. %. The resin further showed a Tg of 58° C.

The parameters relating to the molecular weight of resins and resin compositions were measured in the following manner.

Shodex KF-80M (available from Showa Denko K.K.) was used as a GPC column and incorporated in a heat chamber held at 40° C. of a GPC measurement apparatus ("150C ALC/GPC", available from Waters Co.). The GPC measurement was effected by injecting 200 μl of a sample (a THF-soluble concentration of about 0.1 wt. %) into the column at a THF flow rate of 1 ml/min. and by using an RI (reference index) detector. The calibration curve for molecular weight measurement was prepared by using THF solutions of 10 monodisperse polystyrene standard samples having molecular weights of $0.5\times10^3$, $2.35\times10^3$, $10.2\times10^3$, $35\times10^3$, $110\times10^3$, $200\times10^3$, $470\times10^3$, $1200\times10^3$, $2700\times10^3$ and $8420\times10^3$ (available from Waters Co.).

Synthesis Example 2

A production method similar to that in Synthesis Example 1 was effected except for increasing the divinylbenzene to 0.6 wt. part and lowering the polymerization temperature to obtain a uniform mixture of polystyrene and styrene-n-butyl acrylate copolymer, which showed a THF-insoluble content of 60 wt. %, a Tg of 63° C. and included a THF-soluble content showing peaks at molecular weights of about 9000 and about 90000 and a molecular weight portion of 10000 or below of 15 wt. %.

Synthesis Example 3

150 wt. parts of cumene was charged in a reaction vessel and heated to a reflux temperature, and the following mixture was added dropwise thereto in 4 hours under reflux of the cumene.

| (Monomer mixture) | |
|---|---|
| Styrene | 96 wt. parts |
| n-Butyl acrylate | 4 wt. parts |
| di-tert-Butyl peroxide | 4.2 wt. parts |

Further, the polymerization was completed under reflux of cumene (146°–156° C.), followed by removal of the cumene. The resultant styrene-n-butyl acrylate copolymer showed a main peak at molecular weight of 2000 and a Tg of 56° C.

35 wt. parts of the above styrene-n-butyl acrylate copolymer was dissolved in the following monomer mixture to form a mixture solution.

| (Monomer mixture) | |
|---|---|
| Styrene | 40 wt. parts |
| Methyl methacrylate | 20 wt. parts |
| Divinylbenzene | 0.25 wt. part |
| Benzoyl peroxide | 1.7 wt. part |

To the above mixture solution was added 170 wt. parts of water containing 0.1 wt. part of incompletely saponified polyvinyl alcohol to form a liquid suspension. The suspension was added to a nitrogen-aerated reaction vessel containing 15. wt. parts of water and subjected to 6 hours of suspension polymerization at 70°–95° C. After the reaction, the product was recovered by filtration, de-watered and dried to obtain a composition comprising a uniform mixture of styrene-n-butyl acrylate copolymer and styrene-methyl methacrylate copolymer.

The resin composition showed a THF-insoluble content of 13. wt. %, and included a THF-soluble content showing peaks at molecular weights of about 2500 and about $1.8\times10^4$ on the GPC chart and a portion of molecular weight being 10,000 or below of 42 wt. %. The resin showed a Tg of 53° C.

Comparative Synthesis Example 1

A production method similar to that in Synthesis Example 3 was effected except that the polymerization temperature was adjusted to obtain a resin composition, which showed a THF-insoluble content of 6 wt. %, and included a THF-soluble content showing peaks at molecular weights of about 1500 and $2.3\times10^4$ on the GPC chart and a portion of molecular weight being 10,000 or below of 54 wt. %. The resin showed a Tg of 49° C.

Comparative Synthesis Example 2

20 wt. parts of the polystyrene prepared in Synthesis Example 1 was dissolved in the following monomer mixture to form a mixture solution.

| (Monomer mixture) | |
|---|---|
| Styrene | 60 wt. parts |
| n-Butyl acrylate | 10 wt. parts |
| Divinylbenzene | 0.20 wt. parts |
| t-Butyl peroxyhexanoate | 1.0 wt. parts |

The above mixture solution was subjected to suspension polymerization similar as in Synthesis Example 1 to obtain a composition comprising polystyrene and styrene-n-butyl acrylate copolymer.

The resin composition showed a THF-insoluble content of 75 wt. %, and included a THF-soluble content showing peaks at molecular weights of about 7000 and about $13\times10^4$ on the GPC chart and a portion of molecular weight being 10,000 or below of 11 wt. %. The resin showed a Tg of 65° C.

The present invention will be explained more specifically based on the following Examples wherein "parts" used in describing formulations are by weight.

EXAMPLE 1

| Resin composition of Synthesis | |
|---|---|
| Example 1 | 100 parts |
| Spherical magnetic material having a bulk density of 0.90 g/ml (average particle size of 0.2 micron) | 60 parts |
| Chromium complex of dialkylsalicylic acid | 2 parts |
| Low-molecular weight polypropylene | 3 parts |

The above ingredients were blended and kneaded on a twin-roller mill heated to 150° C. for 20 min. The kneaded product, after cooling, was coarsely crushed and then finely pulverized by a jet mill, followed by classification by a wind-force classifier, to obtain a black fine powder product having a volume-average particle size of 12.2 microns. Further, 0.6 part of hydrophobic colloidal silica fine powder was dry-blended with 100 parts of the black fine powder product (magnetic toner) to obtain a monocomponent developer comprising a negatively chargeable magnetic toner to which hydrophobic colloidal silica was externally added.

The developer was introduced in an image forming apparatus obtained by remodelling a commercially available copying machine ("FC-5", available from Canon K.K.) in which the developing apparatus thereof was remodelled to include an elastic blade 9 of urethane rubber as shown in FIG. 5 and the elastic blade 9 was abutted to the developer-carrying member (sleeve) 6 at a pressure of 30 g/cm.

An electrostatic latent image for reversal development was formed on an OPC photosensitive drum 3 at a primary charge voltage of −600 volts. The spacing between the developing sleeve 6 (enclosing a magnet) and the photosensitive drum 3 was set to 300 microns so that the developer layer on the sleeve 6 did not contact the photosensitive drum 3. The electrostatic image was developed by reversal development under application of an AC bias (f=1800 Hz, Vpp=1200 V) and a DC bias ($V_{DC}$=−390 V) to the developing sleeve, thereby to form a toner image on the OPC photosensitive drum. The resultant toner image was transferred to plain paper at a positive transfer and then fixed onto the plain paper by passing the plain paper carrying toner image through a hot-pressure roller fixer.

As a result, even after 3000 sheets of image formation, no sticking of toner or film formation was observed either on the surface of the elastic blade 9 or the developing sleeve 6, but good toner images were formed.

The same test was also conducted under high temperature—high humidity conditions of 32.5° C. and 85% RH and under low temperature—low humidity conditions of 15° C. and 10% RH, whereby similarly good results were obtained.

Further, even when the image formation was continued up to 5000 sheets of copying while supplying the toner, no problem was observed either.

EXAMPLE 2

A negatively chargeable magnetic toner having a volume-average particle size of 12.8 microns was prepared in a similar manner as in Example 1 except that the resin composition was replaced by one of Synthesis Example 2.

The resultant toner was blended with hydrophobic colloidal silica to obtain a developer similarly as in Example 1. The developer was introduced in the remodelled copying machine used in Example 1 and tested in the same manner as in Example 1, whereby good results were obtained up to 3000 sheets of copying under the respective sets of environmental conditions.

Further, when the image formation was continued up to 5000 sheets, a slight image defect attributable to a damage on the elastic blade from the time of 4000 sheets was observed under the low temperature—low humidity conditions. However, the defect was so slight that it was practically of no problem.

EXAMPLE 3

A negatively chargeable magnetic toner having a volume-average particle size of 11.5 microns was prepared in a similar manner as in Example 1 except that the resin composition was replaced by one of Synthesis Example 3, and the toner was similarly blended with hydrophobic colloidal silica to obtain a developer.

On the other hand, the remodelled copying machine used in Example 1 was further remodelled so that the developing apparatus was replaced by one shown in FIG. 4 and the elastic blade 9 of silicone rubber was abutted against the developing sleeve 6 at a pressure of 35 g/cm.

Then, the above-prepared developer was introduced into the remodelled copying machine and subjected to the image formation test otherwise in the same manner as in Example 1, whereby good results were obtained up to 3000 sheets of copying under the respective sets of environmental conditions.

Further, when the image formation was continued up to 5000 sheets, a slight image defect attributable to spot-like toner sticking onto the sleeve from the time of 3500 sheets was observed under the high temperature—high humidity conditions. However, the defect was so slight that it was practically of no problem.

EXAMPLE 4

A negatively chargeable magnetic toner having a volume-average particle size of 12.4 microns was prepared in a similar manner as in Example 3 except that the magnetic material was replaced by a spherical magnetic material having a bulk density of 0.55 g/ml.

The resultant toner was blended with hydrophobic colloidal silica to obtain a developer similarly as in Example 1. The developer was introduced in the remodelled copying machine used in Example 1 and tested in the same manner as in Example 1, whereby good results were obtained up to 3000 sheets of copying under the respective sets of environmental conditions.

Further, when the image formation was continued up to 5000 sheets, a slight image defect attributable to a filmy toner sticking onto the sleeve from the time of 3500 sheets was observed under the high temperature—high humidity conditions. However, the defect was so slight that it was practically of no problem.

Comparative Example 1

A negatively chargeable magnetic toner having a volume-average particle size of 10.9 microns was prepared in a similar manner as in Example 1 except that the resin composition was replaced by one of Comparative Synthesis Example 1.

The resultant toner was blended with hydrophobic colloidal silica to obtain a developer similarly as in Example 1. The developer was introduced in the remodelled copying machine used in Example 1 and tested in the same manner as in Example 1, image defects in the form of white voids appeared after 2000 sheets even under normal environmental conditions and toner sticking was observed on the surfaces of both the elastic blade 9 and the developing sleeve 6 after the test.

Comparative Example 2

A negatively chargeable magnetic toner having a volume-average particle size of 13.0 microns was prepared in a similar manner as in Example 1 except that the resin composition was replaced by one of Comparative Synthesis Example 2.

The resultant toner was blended with hydrophobic colloidal silica to obtain a developer similarly as in Example 1. The developer was introduced in the remodelled copying machine used in Example 1 and tested in the same manner as in Example 1, poor images with streak-like irregularities attributable to damages on the elastic blade were formed after 2500 sheets under the low temperature—low humidity conditions.

EXAMPLE 5

Hydrophobic colloidal silica fine powder was prepared by treating 100 parts of colloidal silica fine powder (Aerosil #200, available from Nihon Aerosil K.K.) with 20 parts of hexamethyldisilazane and then with 10 parts of dimethylsilicone oil ("KF-96 100CS", available from Shin-etsu Kagaku K.K.) diluted with a solvent.

0.6 part of the resultant hydrophobic colloidal silica was blended with 100 parts of the negatively chargeable magnetic toner prepared in Example 1 to obtain a monocomponent type developer.

The thus obtained developer was supplied to the developing apparatus of an image forming apparatus as shown in FIG. 7 (wherein the elastic blade 9 was disposed to exert an abutting pressure of 30 g/cm in a counter direction with respect to the rotation direction of the developing sleeve 6) and subjected to an image formation test in a similar manner as in Example 1, whereby an even better durability or successive copying characteristic than in Example 1 was obtained due to the lubricating effect given by the silicone oil covering the hydrophobic colloidal silica. Further, good results were obtained under the respective sets of environmental conditions.

As described hereinabove, by using the developer according to the present invention in an image forming apparatus equipped with a developing apparatus wherein a developer is applied onto a developer-carrying member by means of an elastic blade, the developer does not cause toner-sticking or filmy contamination onto the elastic blade or developer-carrying member even under a strong pressing force acting between these members to decrease the torque for driving the developer-carrying member, thus preventing difficulties, such as inversion or peeling of the elastic blade and breakage of drive gear for driving the developer-carrying member, to allow good image formation.

What is claimed is:

1. An image forming apparatus, comprising: an image-bearing member for bearing a latent image, and a developing apparatus for developing the latent image, the developing apparatus comprising:

a developer container for containing a developer, wherein the developer comprises a magnetic toner comprising a binder resin composition and a magnetic material having a bulk density of 0.35 g/ml or higher, said magnetic material being contained in a proportion of 10–70 wt. % of the magnetic toner, said binder resin composition containing 10–70 wt. % of a THF (tetrahydrofuran)-insoluble component and the remainder of a THF-soluble component including a component with a molecular weight of 10000 or below on a GPC (gel permeation chromatography) chromatogram of the THF-soluble component constituting 10–50 wt. % of the binder resin;

a developer-carrying member for carrying and conveying the developer contained in the developer container to a developing zone opposite the image-bearing member, the developer-carrying member comprising a developing sleeve enclosing a magnet; and an elastic blade which flexibly presses against the developer-carrying member to regulate the developer carried and conveyed on the developer-carrying member to a prescribed thickness to form a thin developer layer on the developer-carrying member.

2. The apparatus according to claim 1, wherein said image bearing member comprises an OPC photosensitive drum.

3. The apparatus according to claim 1, wherein said developer comprises magnetic toner particles and hydrophobic colloidal silica fine powder.

4. The apparatus according to claim 3, wherein said hydrophobic colloidal silica fine powder has been treated with a silicone oil or silicone varnish.

5. The apparatus according to claim 1, wherein said binder resin comprises a vinyl polymer or copolymer.

6. The apparatus according to claim 1, wherein said binder resin comprises a styrene polymer or copolymer.

7. The apparatus according to claim 1, wherein said binder resin comprises a non-crosslinked vinyl polymer or copolymer and a crosslinked vinyl polymer or copolymer.

8. The apparatus according to claim 7, wherein said binder resin comprises a non-crosslinked vinyl polymer or copolymer prepared by solution polymerization and a crosslinked vinyl polymer or copolymer prepared by suspension polymerization.

9. The apparatus according to claim 1, wherein said binder resin comprises a non-crosslinked styrene polymer or copolymer and a crosslinked styrene polymer or copolymer.

10. The apparatus according to claim 9, wherein said binder resin comprises a non-crosslinked vinyl polymer or copolymer prepared by solution polymerization and a crosslinked vinyl polymer or copolymer prepared by suspension polymerization.

11. The apparatus according to claim 1, wherein said binder resin comprises a THF-soluble crosslinked first vinyl polymer or copolymer, and a crosslinked second vinyl polymer or copolymer comprising a THF-insoluble matter.

12. The apparatus according to claim 11, wherein the first vinyl polymer or copolymer has been obtained by solution polymerization and the second vinyl polymer or copolymer has been obtained by suspension polymerization.

13. The apparatus according to claim 1, wherein said binder resin comprises a THF-soluble crosslinked first styrene polymer or copolymer, and a crosslinked second styrene polymer or copolymer comprising a THF-insoluble matter.

14. The apparatus according to claim 13, wherein the first styrene polymer or copolymer has been obtained by solution polymerization and the second styrene polymer or copolymer has been obtained by suspension polymerization.

15. The apparatus according to claim 1, wherein said binder resin contains 20–39 wt. % of the component with a molecular weight of 10000 or below.

16. The apparatus according to claim 1, wherein the THF-soluble content of the binder resin provides a GPC chromatogram showing a peak in the molecular weight region of 2000 or more to less than 15000 and a peak or shoulder in the molecular weight region of 15,000– 100,000.

17. The apparatus according to claim 1, wherein the THF-soluble component of the binder resin provides a GPC chromatogram showing a peak in the molecular weight region of 2,000–10,000.

18. The apparatus according to claim 1, wherein the THF-soluble component of the binder resin provides a GPC chromatogram showing a peak in the molecular weight region of 2000–8000 and a peak or shoulder in the molecular weight region of 20,000–70,000.

19. The apparatus according to claim 1, wherein said elastic blade comprises an elastic plate formed of a material selected from the group consisting of elastic rubber, elastic metal and elastic resin.

20. The apparatus according to claim 19, wherein said elastic blade is disposed in a forward direction with respect to the moving direction of the developer-carrying member.

21. The apparatus according to claim 19, wherein said elastic blade is disposed in a counter direction with respect to the moving direction of the developer-carrying member.

22. The apparatus according to claim 1, wherein said elastic blade comprises an elastic plate formed of a rubber selected from the group consisting of urethane rubber, silicone rubber and nitrile-butadiene rubber.

23. The apparatus according to claim 1, wherein said magnetic toner contains a magnetic material having a bulk density of 0.6 g/ml or higher.

24. The apparatus according to claim 1, wherein said magnetic toner contains a spherical magnetic material having a bulk density of 0.8 g/ml or higher.

25. The apparatus according to claim 1, wherein said elastic blade is pressed at a linear pressure of 5 –80 g/cm against the surface of the developer-carrying member carrying a layer of the developer.

26. A facsimile apparatus, comprising: an electrophotographic apparatus and a receiving means for receiving image data from a remote terminal, wherein said electrophotographic apparatus comprises: an image-bearing member for bearing a latent image, and a developing apparatus for developing the latent image, the developing apparatus comprising:

a developer container for containing a developer, wherein the developer comprises a magnetic toner comprising a binder resin composition and a magnetic material having a bulk density of 0.35 g/ml or higher, said magnetic material being contained in a proportion of 10–70 wt. % of the magnetic toner, said binder resin composition containing 10–70 wt. % of THF (tetrahydrofuran)-insoluble component and the remainder of a THF-soluble component including a component with a molecular weight of 10000 or below on a GPC (gel permeation chromatography) chromatogram of the THF-soluble component constituting 10–50 wt. % of the binder resin;

a developer-carrying member for carrying and conveying the developer contained in the developer container to a developing zone opposite the image-bearing member, the developer-carrying member comprising a developing sleeve enclosing a magnet; and an elastic blade which flexibly presses against the developer-carrying member to regulate the developer carried and conveyed on the developer-carrying member to a prescribed thickness to form a thin developer layer on the developer-carrying member.

27. An apparatus unit, comprising: an image-bearing member for bearing a latent image, and a developing apparatus for developing the latent image, the developing apparatus comprising:

a developer container for containing a developer, wherein the developer comprises a magnetic toner comprising a binder resin composition and a magnetic material having a bulk density of 0.35 g/ml or higher, said magnetic material being contained in a proportion of 10–70 wt. % of the magnetic toner, said binder resin composition containing 10–70 wt. % of THF (tetrahydrofuran)-insoluble component and the remainder of a THF-soluble component including a component with a molecular weight of 10000 or below on a GPC (gel permeation chromatography) chromatogram of the THF-soluble component constituting 10–50 wt. % of the binder resin;

a developer-carrying member for carrying and conveying the developer contained in the developer container to a developing zone opposite the image-bearing member, the developer-carrying member comprising a developing sleeve enclosing a magnet, and an elastic blade which flexibly presses against the developer-carrying member to regulate the developer carried and conveyed on the developer-carrying member to a prescribed thickness to form a thin developer layer on the developer-carrying member.

wherein said developing apparatus is supported integrally together with the image-bearing member to form a single unit, which can be connected to or released from an apparatus body as desired.

28. The apparatus unit according to claim 27, wherein said image bearing member comprises an OPC photosensitive drum.

29. The apparatus unit according to claim 28, wherein said hydrophobic colloidal silica fine powder has been treated with a silicone oil or silicone varnish.

30. The apparatus unit according to claim 27, wherein said developer comprises magnetic toner particles and hydrophobic colloidal silica fine powder.

31. The apparatus unit according to claim 30, wherein said the first styrene polymer or copolymer has been obtained by solution polymerization and the second styrene polymer or copolymer has been obtained by suspension polymerization.

32. The apparatus unit according to claim 27, wherein said binder resin comprises a vinyl polymer or copolymer.

33. The apparatus unit according to claim 27, wherein said binder resin comprises a styrene polymer or copolymer.

34. The apparatus unit according to claim 27, wherein said binder resin comprises a non-crosslinked vinyl polymer or copolymer and a crosslinked vinyl polymer or copolymer.

35. The apparatus unit according to claim 34, wherein said binder resin comprises a non-crosslinked vinyl polymer or copolymer prepared by solution polymerization and a crosslinked vinyl polymer or copolymer prepared by suspension polymerization.

36. The apparatus unit according to claim 27, wherein said binder resin comprises a non-crosslinked styrene polymer or copolymer and a crosslinked styrene polymer or copolymer.

37. The apparatus unit according to claim 36, wherein said binder resin comprises a non-crosslinked vinyl polymer or copolymer prepared by solution polymerization and a crosslinked styrene polymer or copolymer prepared by suspension polymerization.

38. The apparatus unit according to claim 27, wherein said binder resin comprises a THF-soluble crosslinked first vinyl polymer or copolymer, and a crosslinked second vinyl polymer or copolymer comprising a THF-insoluble matter.

39. The apparatus unit according to claim 38, wherein said the first vinyl polymer or copolymer has been obtained by solution polymerization and the second vinyl polymer or copolymer has been obtained by suspension polymerization.

40. The apparatus unit according to claim 27, wherein said binder resin comprises a THF-soluble crosslinked first styrene polymer or copolymer, and a crosslinked second styrene polymer or copolymer comprising a THF-insoluble matter.

41. The apparatus unit according to claim 27, wherein said binder resin contains 20–39 wt. % of the component with a molecular weight of 10,000 or below.

42. The apparatus unit according to claim 27, wherein the THF-soluble component of the binder resin provides a GPC chromatogram showing a peak in the molecular weight region of 2,000 or more to less than 15,000 and a peak or shoulder in the molecular weight region of 15,000– 100,000.

43. The apparatus unit according to claim 27, wherein the THF-soluble component of the binder resin provides a GPC chromatogram showing a peak in the molecular weight region of 2,000–10,000.

44. The apparatus unit according to claim 27, wherein the THF-soluble component of the binder resin provides GPC chromatogram showing a peak in the molecular weight region of 2,000–8,000 and a peak or shoulder in the molecular weight region of 20,000–70,000.

45. The apparatus unit according to claim 27, wherein said elastic blade comprises an elastic plate formed of a material selected from the group consisting of elastic rubber, elastic metal and elastic resin.

46. The apparatus unit according to claim 45, wherein said elastic blade is disposed in a forward direction with respect to the moving direction of the developer-carrying member.

47. The apparatus unit according to claim 45, wherein said elastic blade is disposed in a counter direction with respect to the moving direction of the developer-carrying member.

48. The apparatus unit according to claim 27, wherein said elastic blade comprises an elastic plate formed of a rubber selected from the group consisting of urethane rubber, silicone rubber and nitrile-butadiene rubber.

49. The apparatus unit according to claim 27, wherein said magnetic toner contains a magnetic material having a bulk density of 0.6 g/ml or higher.

50. The apparatus unit according to claim 27, wherein said magnetic toner contains a spherical magnetic material having a bulk density of 0.8 g/ml or higher.

51. The apparatus unit according to claim 27, wherein said elastic blade is pressed at a linear pressure of 5–80 g/cm against the surface of the developer carrying member carrying a layer of the developer.

52. A developer apparatus comprising:

a developer container for containing a developer, wherein the developer comprises a magnetic toner comprising a binder resin composition and a magnetic material having a bulk density of 0.35 g/ml or higher, said magnetic material being contained in a proportion of 10–70 wt. % of the magnetic toner, said binder resin composition containing 10–70 wt. % of THF (tetrahydrofuran)-insoluble component and the remainder of a THF-soluble component including a component with a molecular weight of 10,000 or below on a GPC (gel permeation chromatography) chromatogram of the THF-soluble component constituting 10–50 wt. % of the binder resin;

a developer-carrying member for carrying and conveying the developer contained in the developer container to a developing zone, the developer-carrying member comprising a developing sleeve enclosing a magnet; and a developer layer thickness regulating member which elastically presses against the developer-carrying member to regulate the developer carried and conveyed on the developer-carrying member to a prescribed thickness to form a thin developer layer on the developer-carrying member.

53. The apparatus according to claim 52, wherein said developer comprises magnetic toner particles and hydrophobic colloidal silica fine powder.

54. The apparatus according to claim 53, wherein said hydrophobic colloidal silica fine powder has been treated with a silicone oil or silicone varnish.

55. The apparatus according to claim 52, wherein said binder resin comprises a vinyl polymer or copolymer.

56. The apparatus according to claim 52, wherein said binder resin comprises a styrene polymer or copolymer.

57. The apparatus according to claim 52, wherein said binder resin comprises a non-crosslinked vinyl polymer or copolymer and a crosslinked vinyl polymer or copolymer.

58. The apparatus according to claim 57, wherein said binder resin comprises a non-crosslinked vinyl polymer or copolymer prepared by solution polymerization and a crosslinked vinyl polymer or copolymer prepared by suspension polymerization.

59. The apparatus according to claim 52, wherein said binder resin comprises a non-crosslinked styrene polymer or copolymer and a crosslinked styrene polymer or copolymer.

60. The apparatus according to claim 59, wherein said binder resin comprises a non-crosslinked vinyl polymer or copolymer prepared by solution polymerization and a crosslinked vinyl polymer or copolymer prepared by suspension polymerization.

61. The apparatus according to claim 52, wherein said binder resin comprises a THF-soluble crosslinked first vinyl polymer or copolymer, and a crosslinked second vinyl polymer or copolymer comprising a THF-insoluble matter.

62. The apparatus according to claim 61, wherein the first vinyl polymer or copolymer has been obtained by solution polymerization and the second vinyl polymer or copolymer has been obtained by suspension polymerization.

63. The apparatus according to claim 52, wherein said binder resin comprises a THF-soluble crosslinked first styrene polymer or copolymer, and a crosslinked second styrene polymer or copolymer comprising a THF-insoluble matter.

64. The apparatus according to claim 63, wherein the first styrene polymer or copolymer has been obtained by solution polymerization and the second styrene polymer or copolymer has been obtained by suspension polymerization.

65. The apparatus according to claim 52, wherein said binder resin contains 20–39 wt. % of the component with a molecular weight of 10,000 or below.

66. The apparatus according to claim 52, wherein the THF-soluble component of the binder resin provides a GPC chromatogram showing a peak in the molecular weight region of 2,000 or more to less than 15,000 and a peak or shoulder in the molecular weight region of 15,000– 100,000.

67. The apparatus according to claim 52, wherein the THF-soluble component of the binder resin provides a GPC chromatogram showing a peak in the molecular weight region of 2,000–10,000.

68. The apparatus according to claim 52, wherein the THF-soluble component of the binder resin provides a GPC chromatogram showing a peak in the molecular weight region of 2,000–8,000 and a peak or shoulder in the molecular weight region of 20,000–70,000.

69. The apparatus according to claim 52, wherein said developer layer thickness regulating member comprises an elastic blade.

70. The apparatus according to claim 69, wherein said elastic blade comprises an elastic plate formed of a material selected from the group consisting of elastic rubber, elastic metal and elastic resin.

71. The apparatus according to claim 70, wherein said elastic blade is disposed in a forward direction with respect to the moving direction of the developer-carrying member.

72. The apparatus according to claim 70, wherein said elastic blade is disposed in a counter direction with respect to the moving direction of the developer-carrying member.

73. The apparatus according to claim 69, wherein said elastic blade is pressed at a linear pressure of 5–80 g/cm against the surface of the developer carrying member carrying a layer of the developer.

74. The apparatus according to claim 69, wherein said elastic blade comprises an elastic plate formed of a rubber selected from the group consisting of urethane rubber, silicone rubber and nitrile-butadiene rubber.

75. The apparatus according to claim 52, wherein said magnetic toner contains a magnetic material having a bulk density of 0.35 g/ml or higher.

76. The apparatus according to claim 52, wherein said magnetic toner contains a spherical magnetic material having a bulk density of 0.8 g/ml or higher.

77. An apparatus unit comprising:

an image bearing member for bearing a latent image, and a developing apparatus for developing the latent image, the developing apparatus comprising:

a developer container for containing a developer, wherein the developer comprises a magnetic toner comprising a binder resin composition and a magnetic material having a bulk density of 0.35 g/ml or higher, said magnetic material being contained in a proportion of 10–70 wt. % of the magnetic toner, said binder resin composition containing 10–70 wt. % of a THF (tetrahydrofuran)-insoluble component and the remainder of a THF-soluble component including a component with a molecular weight of 10,000 or below on a GPC (gel permeation chromatography) chromatogram of the THF-soluble component constituting 10–50 wt. % of the binder resin;

a developer-carrying member for carrying and conveying the developer contained in the developer container to a developing zone, the developer-carrying member comprising a developing sleeve enclosing a magnet; and a developer layer thickness regulating member which elastically presses against the developer-carrying member to regulate the developer carried and conveyed on the developer-carrying member to a prescribed thickness to form a thin developer layer on the developer-carrying member, wherein said developing apparatus is supported integrally together with the image-bearing member to form a single unit, which can be connected to or released from an apparatus body as desired.

78. The apparatus unit according to claim 77, wherein said image bearing member comprises an OPC photosensitive drum.

79. The apparatus unit according to claim 77 wherein said developer comprises magnetic toner particles and hydrophobic colloidal silica fine powder.

80. The apparatus unit according to claim 79, wherein said hydrophobic colloidal silica fine powder has been treated with a silicone oil or silicone varnish.

81. The apparatus unit according to claim 77, wherein said binder resin comprises a vinyl polymer or copolymer.

82. The apparatus unit according to claim 77, wherein said binder resin comprises a styrene polymer or copolymer.

83. The apparatus unit according to claim 77, wherein said binder resin comprises a non-crosslinked vinyl polymer or copolymer and a crosslinked vinyl polymer or copolymer.

84. The apparatus unit according to claim 83, wherein said binder resin comprises a non-crosslinked vinyl polymer or copolymer prepared by solution polymerization and a crosslinked vinyl polymer or copolymer prepared by suspension polymerization.

85. The apparatus unit according to claim 77, wherein said binder resin comprises a non-crosslinked styrene polymer or copolymer and a crosslinked styrene polymer or copolymer.

86. The apparatus unit according to claim 85, wherein said binder resin comprises a non-crosslinked vinyl polymer or copolymer prepared by solution polymerization and a crosslinked vinyl polymer or copolymer prepared by suspension polymerization.

87. The apparatus according to claim 77, wherein said binder resin comprises a THF-soluble crosslinked first vinyl polymer or copolymer, and a crosslinked second vinyl polymer or copolymer comprising a THF-insoluble matter.

88. The apparatus according to claim 87, wherein the first vinyl polymer or copolymer has been obtained by solution polymerization and the second vinyl polymer or copolymer has been obtained by suspension polymerization.

89. The apparatus unit according to claim 77, wherein said binder resin comprises a THF-soluble crosslinked first styrene polymer or copolymer, and a crosslinked second styrene polymer or copolymer comprising a THF-insoluble matter.

90. The apparatus unit according to claim 89, wherein the first styrene polymer or copolymer has been obtained by solution polymerization and the second styrene polymer or copolymer has been obtained by suspension polymerization.

91. The apparatus unit according to claim 77, wherein said binder resin contains 20–39 wt. % of the component with a molecular weight of 10,000 or below.

92. The apparatus unit according to claim 77, wherein the THF-soluble component of the binder resin provides a GPC chromatogram showing a peak in the molecular weight region of 2,000 or more to less than 15,000 and a peak or shoulder in the molecular weight region of 15,000– 100,000.

93. The apparatus unit according to claim 77, wherein the THF-soluble component of the binder resin provides a GPC chromatogram showing a peak in the molecular weight region of 2,000–10,000.

94. The apparatus unit according to claim 77, wherein the THF-soluble component of the binder resin provides a GPC chromatogram showing a peak in the molecular weight region of 2,000–8,000 and a peak or shoulder in the molecular weight region of 20,000–70,000.

95. The apparatus unit according to claim 77, wherein said magnetic toner contains a magnetic material having a bulk density of 0.6 g/ml or higher.

96. The apparatus unit according to claim 77, wherein said magnetic toner contains a spherical magnetic material having a bulk density of 0.8 g/ml or higher.

97. The apparatus unit according to claim 77, wherein said elastic blade is pressed at a linear pressure of 5–80 g/cm against the surface of the developer carrying member carrying a layer of the developer.

* * * * *